US012379191B2

(12) United States Patent
Gaspard

(10) Patent No.: US 12,379,191 B2
(45) Date of Patent: Aug. 5, 2025

(54) SAFETY NET

(71) Applicant: Craig Gaspard, Prairieville, LA (US)

(72) Inventor: Craig Gaspard, Prairieville, LA (US)

( * ) Notice: Subject to any disclaimer, the term of this patent is extended or adjusted under 35 U.S.C. 154(b) by 80 days.

(21) Appl. No.: 18/497,236

(22) Filed: Oct. 30, 2023

(65) Prior Publication Data

US 2025/0137758 A1 May 1, 2025

(51) Int. Cl.
*F41H 13/00* (2006.01)
*F41B 11/62* (2013.01)

(52) U.S. Cl.
CPC ..... *F41H 13/0006* (2013.01); *F41H 13/0025* (2013.01); *F41B 11/62* (2013.01)

(58) Field of Classification Search
CPC ... F41H 13/0006; F41H 13/0025; F41B 11/62
USPC ..... 89/1.34
See application file for complete search history.

(56) References Cited

U.S. PATENT DOCUMENTS 3,378,742 A * 4/1968 Telkamp ..... G05D 3/127 318/673
D797,723 S * 9/2017 Lee ..... D14/341
9,841,259 B2 * 12/2017 Phillips ..... F41A 17/063
10,110,613 B2 * 10/2018 Swaminathan ..... G06F 9/30036
11,483,454 B2 * 10/2022 Vilermo ..... H04R 1/406
2003/0152892 A1 * 8/2003 Huang ..... F41G 3/2694 434/11
2006/0042142 A1 * 3/2006 Sinha ..... F41A 17/063 42/1.01
2007/0007384 A1 * 1/2007 Sliwa ..... B64D 45/0053 244/30
2010/0227298 A1 * 9/2010 Charles ..... F41A 33/00 434/21
2016/0349019 A1 * 12/2016 Phillips ..... F41H 13/0031
2016/0352755 A1 * 12/2016 Swaminathan ..... H04L 9/0618
2018/0106577 A1 * 4/2018 Phillips ..... F41A 17/063
2019/0162513 A1 * 5/2019 Crouch ..... F42B 30/14

OTHER PUBLICATIONS

Tactical Net Guns Net Launchers, NetGun.com home page, captured Oct. 23, 2023.

* cited by examiner

*Primary Examiner* — Michael D David
(74) *Attorney, Agent, or Firm* — Edel Patents LLC; John B. Edel

(57) ABSTRACT

Safety net devices described herein may include a microphone array, a net launcher, a rotation control device, a fireable electroshock weapon, and a camera. The safety net device may be set up to automatically reorient and fire a net in the direction of a high decibel event upon detection of that high decibel event. The fireable electroshock weapon and the camera may be remotely controlled by an operator as part of a response to the high decibel event.

20 Claims, 4 Drawing Sheets

SAFETY NET

Safety net devices described herein may be used in active shooter situations to mitigate harm. Certain safety net devices disclosed herein may include a net launcher and a fireable electroshock weapon. These devices may take immediate action to diminish the threat posed by an active shooter and may further diminish that threat through the use of remote-controlled video monitoring and a remote operated fireable electroshock weapon.

DETAILED DESCRIPTION

Figure 1:
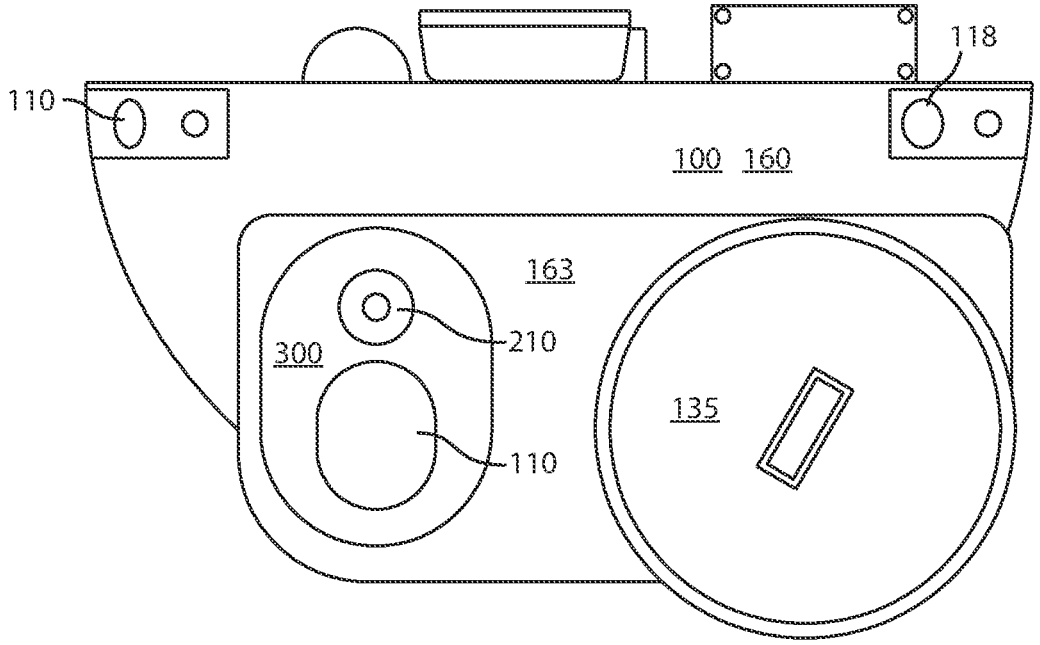
FIG. 1 is an elevation view of the safety net device.
Figure 2:
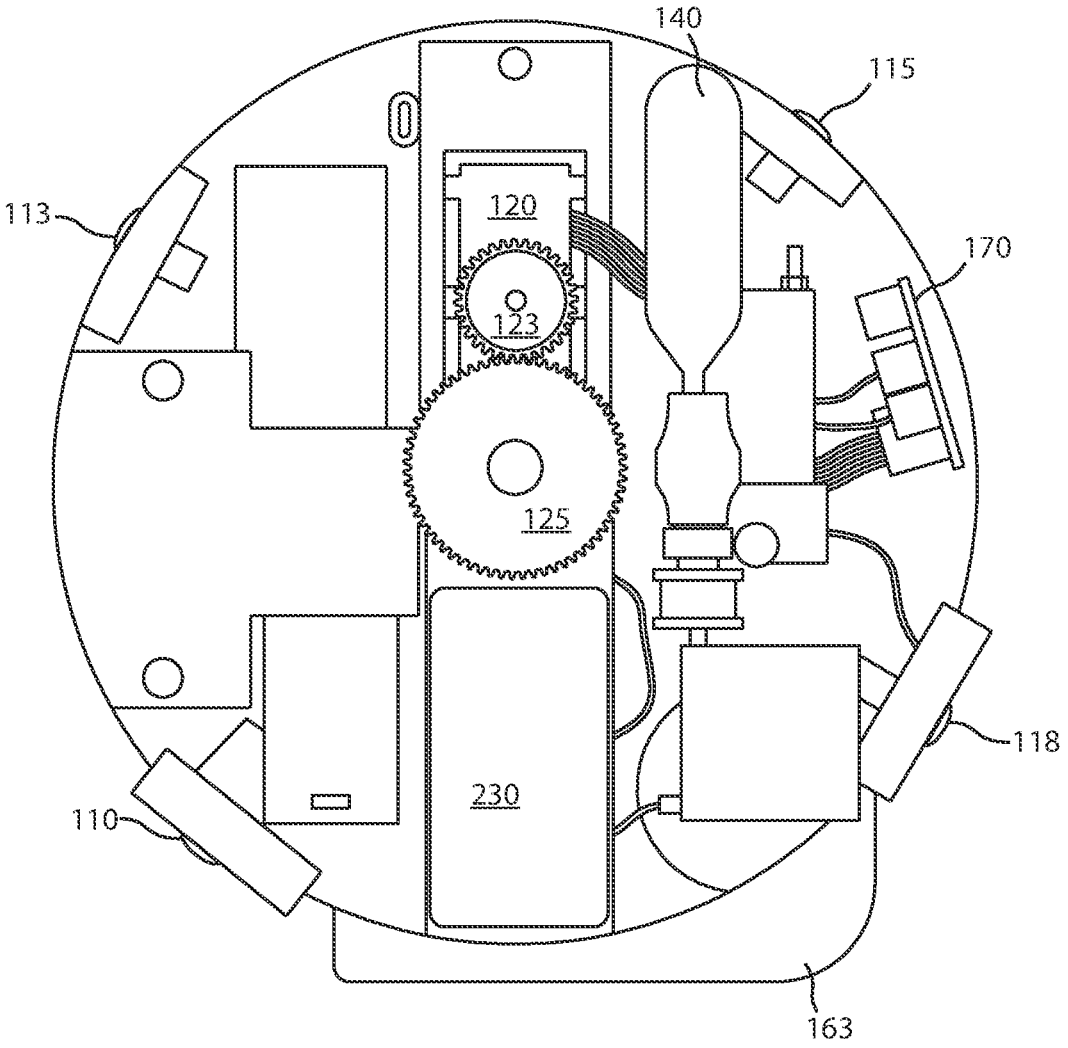
FIG. 2 is a plan view of the safety net device.
Figure 3:
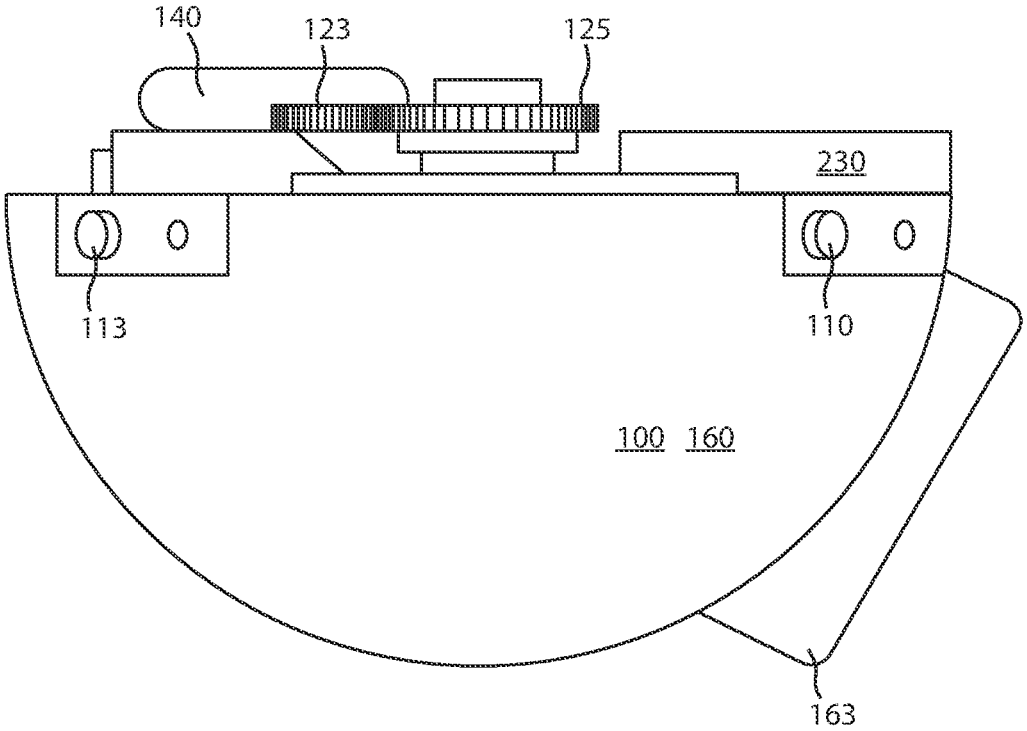
FIG. 3 is a side view of the safety net device.
Figure 4:
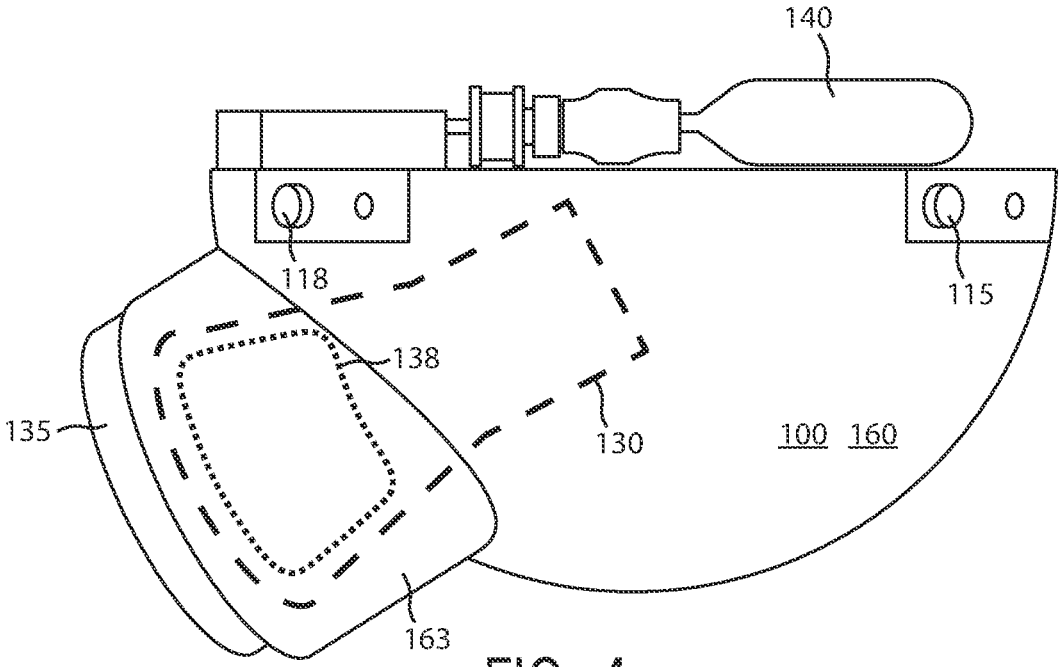
FIG. 4 is a side view of the safety net device.

As depicted in FIGS. 1-5 the safety net device 100 includes:

microphone number one 110,
microphone number two 113,
microphone number three 115,
microphone number four 118,
pivot servo motor 120,
pivot servo gear 123,
center pivot gear 125,
net launcher 130,
net launcher cap 135,
net 138,
$CO_2$ cartridge 140,
internal housing structure 150,
external housing 160,
external housing forward protrusion 163,
power unit 170,
camera 210,
single-board computer 230,
multiplexer 240,
transceiver 250,
battery 260,
micro controller 270,
articulating platform 300,
platform control servo 308,
first platform actuating arm 310,
platform actuating joint 313,
second platform actuating arm 316,
fireable electroshock weapon 330, and
connector 340.

The safety net device described herein may attach to the ceiling of a room. For example, the safety net device may be centrally located on the ceiling of a classroom. The location of the safety net device is not particularly limited to rooms as it may be used in hallways and other sufficiently open spaces for the safety net device to operate whether those spaces are indoors or outdoors.

The safety net device may be attached to the ceiling or some other overhead structure by connecting the center pivot gear to the ceiling or overhead structure. An intermediate piece such as a bracket may be used as needed.

Once installed, the orientation of the safety net device represented by the orientation of the direction of fire of the net launcher is not of particular importance. However, it may be advantageous to install the safety net device such that it is oriented toward the center of the room in cases where the safety net device is not centrally located in the room.

Microphone number one, microphone number two, microphone number three, and microphone number four each remain active and listening for noises of sufficient volume to be characterized as a possible or likely gunshot.

In one example, a high decibel event occurs in a room with a safety device. The sound from the high decibel event is processed through at least two of the microphones for stereo location sufficient to identify an angular rotational adjustment needed for firing the net launcher at the source of the sound. The safety net device immediately calculates the location of the high decibel event, rotates to align with the location of the high decibel event, and fires the net launcher in the direction of the high decibel event.

As used herein, a "high decibel event" is an event measuring 140 dB or higher at the safety net device. This threshold may be adjusted as needed to increase or decrease the number or type of events that would be considered high decibel events. In such cases where the threshold is other than 140 dB the decibel level is indicated as part of the phrase high decibel event. For example, any of the embodiments described herein could be configured such that they respond only to 130 dB high decibel events, 135 dB high decibel events, 145 dB high decibel events, 150 dB high decibel events, 155 dB high decibel events, or 160 dB high decibel events.

In certain examples, the microphones may be sound level sensors that are adjustable such that adjustments at the microphone adjust the volume threshold for what would be considered a high decibel event. In one example, sound level sensors are adjustable by screwdriver to control the level of volume triggering action.

In practice, a gunshot may be identified through stereo location. The information picked up by the microphones may quickly process a firing solution for the net launcher. If, for example, it is determined that the firing sound originated from 30° right of the current alignment of the net launcher then the safety net device would immediately pivot 30° to the right and fire the net launcher as soon as the pivot is complete. The simplicity of processing sound and simplicity of motion allow for the detection, calculation, pivot, and fire sequence to take place in a fraction of a second.

As used herein, the phrase "stereo location" encompasses the various methodologies by which audio from two or more microphones may be used to identify or approximate a relative or absolute location of the origin of a sound. Stereo location may be as simple as evaluating which microphones pick up a threshold level sound and applying a rule based on the input. For example, if only microphone one and microphone two pick up a high decibel event, the safety net device may pivot 90° right. Stereo location may also include comparison of waveform data from each microphone to evaluate millisecond level offsets between waveforms of different microphones, waveform intensity comparisons, or both. Further, artificial intelligence training may be conducted using microphone data and known weapon sounds and headings in a manner that allows artificial intelligence tools to identify the origin of high decibel events. Any combination of these stereo location techniques may be used to evaluate a composite stereo location or to correct a primary method of stereo location.

Following the high decibel event, the safety net device may send one or more notices alerting the various groups of people that may need to take action in response to a possible firearm discharge. In addition, the camera would be activated to allow personnel to assess, monitor, and take further action based on the information provided by the camera. Because the camera is configured to face in the same direction as the net launcher, the camera would almost instantly align with the source of the high decibel event and be capable of capturing images so closely associated in time with the high decibel event that the initial images captured by the camera are effectively capturing the completion of actions directly associated with the high decibel event. For example, the reaction time of the safety net device may be such that the camera captures an image of an active shooter still pointing the firearm in the direction that the firearm was fired. Because the firing of the net may occur within a fraction of a second, the initial information gathered and communicated to relevant parties may include an image indicating that the person firing the gun was captured by the net. The initial image communicating the result of the firing of the net launcher may quickly provide information about the extent to which the person firing the firearm has been disabled by the net. Initial information such as these important initial images; pre-firing, post-firing, or both; may be communicated at high speed through cellular, local wireless networks or other networks.

After the initial detection, calculation, pivot, and fire sequence accompanied by the initial image capturing, a video feed from the camera may be provided to a person and/or location for further control of the safety net device. That control may include control over the pivoting of the safety net device including the camera and control over the articulating platform that allows control over the up and down orientation of the camera. Thus, an operator who may also be a first responder could control the safety net device so that they could view the surroundings of the safety net device.

As that phrase is used herein, "first responder" includes all personnel with responsibilities relating to the discharge of a firearm in the vicinity of the safety net device. These personnel may include police, fire personnel, emergency coordinators, emergency management system personnel, teachers, administrators, and managers.

The microcontroller may fully or partially control the safety net device operation through the firing of the net launcher. The microcontroller may handle the input, rotation, and firing in a variety of ways. For example, the firing of the net launcher may be based on a simple delay sufficient for the completion of the reorientation of the safety net device or the microcontroller may wait until confirmation of reorientation of the safety net device before firing the net launcher. Control of the safety net device may transition from the microcontroller to the single board computer after the microcontroller has completed execution of a series of initial steps. An example microcontroller is the UNO R4 WiFi, SKU ABX00087, manufactured by Arduino.

The operator's ability to control the safety net device is enhanced by the ability of the operator to take active measures in the surroundings of the safety net device. A fireable electroshock weapon may be included on the articulating platform such that the fireable electroshock weapon may be discharged at a target within the field of view of the camera. The operator would have control over the discharge of the fireable electroshock weapon and would make decisions regarding the fireable electroshock weapon based on the audio and video evidence provided from the safety net device. The ability of an operator to successfully fire on and immobilize a target with the fireable electroshock weapon may be enhanced by the following: Because the fireable electroshock weapon and the camera both rotate with the safety net device and vertically reorient based on the movement of the articulating platform the fireable electroshock weapon will tend to consistently fire into an area within the field of view of the camera. The safety net device may be designed or adjusted such that the center of the field of view of the camera is the location into which the fireable electroshock weapon fires. Regardless of whether the location into which the fireable electroshock weapon fires is centered within the field of view of the camera, an indicator may be added to the video display observed by the operator allowing the operator to aim the fireable electroshock weapon. The indicator may be crosshairs, a box, a circle, or any other similar type of indication sufficient to aid the operator in the accurate firing of the fireable electroshock weapon.

Operator control of the safety net device may be assisted by artificial intelligence object detection algorithms and object tracking software. Such algorithms and software may automatically track and reorient the camera to follow an individual identified by the operator, to follow any person appearing to possess a firearm, or to track an individual best matching the heading associated with the high decibel event. Artificial intelligence detection training may be conducted or incorporated from available sources for the purpose of assisting with any of these tracking features.

Upon successful firing of the fireable electroshock weapon the subject fired upon may be selectively disabled by energizing of the weapon. For example, the firing of the fireable electroshock weapon may cause two barbs to break the skin of the subject fired upon and the operator may energize the two barbs with a voltage by pressing a button. The barbs may intermittently be energized and deenergized according to the operator's judgment until the subject fired upon can be reached and subdued by authorities or first responders. The use of the fireable electroshock weapon may include limitations consistent with the goal of immobilizing the subject fired upon until that person may be subdued by authorities or first responders. For example, on-off cycles or other limitations that protect the fireable electroshock weapon from damage or failure prior to the arrival of authorities or first responders may be employed.

An operator may manually control the safety net device along with the orientation of the camera and the fireable electroshock weapon manually by way of a joystick or other controller.

The rotation of the safety net device may be controlled by a pivot servo motor attached to a pivot servo gear. The pivot servo gear may mesh with a center pivot gear which either directly or indirectly attaches to the ceiling or other structure. Using this arrangement, the pivot servo motor may allow the safety net device to pivot to any rotational orientation.

The net launcher launches a net during an initial sequence after a high decibel event. The net launcher is powered by a $CO_2$ cartridge and the activation of the net launcher launches the net such that the net launcher cap is removed and the net proceeds to its target. An example net launcher would be the professional net gun sold under the name UltraNet by Wildlife Capture Services, LLC, P.O. Box 334, Flagstaff, AZ 86002.

Most of the components are contained within the external housing which includes the external housing forward protrusion. The various operational components of the safety net device are in most cases secured to either the internal housing structure or the external housing.

The net launcher may operate with a rupture disc separating the net from the $CO_2$ cartridge. However, alternate propulsion means may be used for the launching of the net including the use of combustible propellants and mechanical launching.

The $CO_2$ cartridge may apply 850 psi into four individual barrels of the net launcher to create the force that launches the net. The net may for example be an 8-foot×8-foot net such as those used to capture wildlife. The net may have weights on the net's periphery which are launched at opposing angles during the firing of the net, and those weights may pull the net out of the net launcher. The net may be constructed of nylon or other polymers. The net launcher and net may be of a type used for the capture of large game animals.

As that phrase is used herein, "effective net diameter" represents the diameter of the largest circle fitting over the net. Thus, a 4-foot×6-foot net would have an effective net diameter of 4 feet and an 8-foot×8-foot net would have an effective diameter of eight feet.

The power unit may adapt the available power to a form used and stored by the safety net device. For example, the power unit may be adapted to receive 24-volt direct current from a fire protection or other similar system. The power unit may also be adapted to receive power from 120 V alternating current. The power unit may also charge the battery and distribute power to the various other components either directly or indirectly. The power unit may for example output 5-volt direct current to various electronic components. Because the fireable electroshock weapon has energy needs that vary significantly from most other electronic components, the fireable electroshock weapon may have its own independent energy storage and handling systems such is as typical with hand-held fireable electroshock weapons. The fireable electroshock weapon may however be charged by the power unit.

A single-board computer may control the operation of the articulating platform, the camera, the servos, and the fireable electroshock weapon. The single-board computer may also interface with the transceiver handling all the wireless communication incoming and outgoing to allow an operator to fully control the safety net device as described above. A multiplexer may be used to handle data input to the single board computer from other components.

As that phrase is used herein "single-board computer" includes computers built on a circuit board that for example include a microprocessor, memory, and communication capabilities. An example of a single-board computer is the Raspberry Pi 5 from the Raspberry Pi Foundation and Broadcom.

A standalone micro controller may be used to quickly process the information from a high decibel event and control the initial detection, calculation, pivot, and fire sequence associated with a high decibel event.

The articulating platform may adjust its vertical orientation based on the operation of a platform control servo which connects to the articulating platform by way of a first platform actuating arm, a platform actuating joint, and a second platform actuating arm which is connected to the articulating platform.

Figure 5:
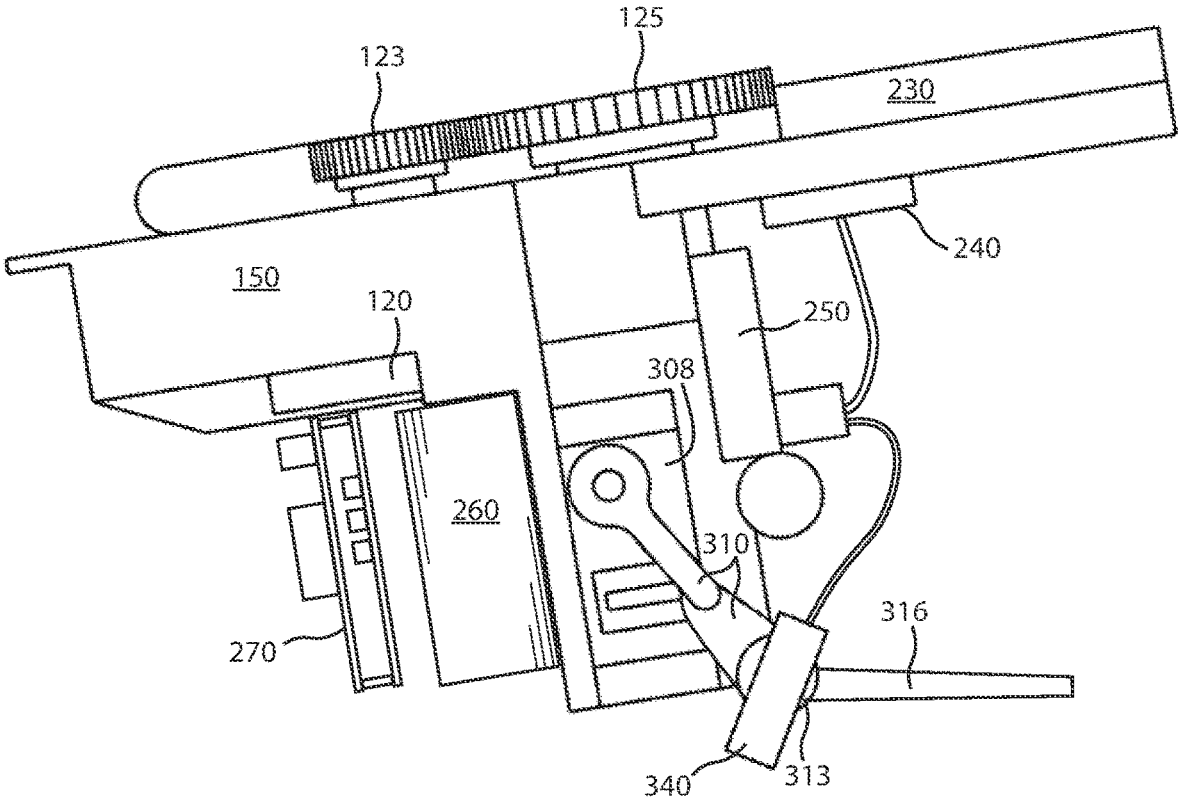
FIG. 5 is a side view of internal components of the safety net device.

The connector depicted in FIG. 5 may provide the video feed from the camera directly to the transceiver for observation by the operator.

Additional analysis criteria may be used to determine if a firearm has been discharged thereby acting as a curb against firing the net launcher when a high decibel event has occurred, but no firearm was discharged. Criteria such as evaluating various soundwave characteristics may be established as a prerequisite to firing the net launcher. Characteristics such as the duration of a sound within certain decibel ranges may be used for this purpose. Machine learning may be used to establish criteria for firing the net launcher that are not solely based on a high decibel event criterion. Collectively, a set of criteria may be established for determining whether a firearm was discharged in the vicinity of the safety net device. These criteria may be generically referred to as "firearm discharge evaluation criteria" with any evaluation according to those criteria having sufficient confidence that a firearm was discharged being referred to herein as a "positive evaluation of a firearm discharge." Thus, with some number of criteria being met, a positive evaluation of firearm discharge would lead to a pivoting and firing of the net launcher. Among other information that could be used as firearm discharge evaluation criteria are information from infrared cameras including images that may contain indications of a muzzle flash. Signals from metal detectors could also be used either as a firearm discharge evaluation criterion or as a criterion for placing the safety net device on a higher level of alert.

The initial detection of a high decibel event may immediately trigger the sending of a text message generated by the single-board computer even before the safety net device pivots to capture any images that may include the source of the high decibel event. That communication may indicate the location of the detected high decibel event and a warning regarding the possibility of a firearm discharge.

The barbs from the fireable electrode weapon may have a range of 15 to 30 feet.

The fireable electroshock weapon may be configured as a custom component within the safety net device. However, commercially available cartridge based fireable electroshock weapons may be included within the safety net device in a way that allows the above-described cooperative operation with the articulating platform provided that the device is adequately wired for control by the safety net device systems such as the single board computer. In such a case the fireable electric weapon's firing cartridge may be removed and placed in the articulating platform with the wiring of the fireable electroshock weapon connected such that the firing and energizing of the weapon operates similarly to an unaltered fireable electroshock weapon.

As that phrase is used herein "fireable electroshock weapon" includes conducted energy weapons that fire pairs of barbed darts connected to the weapon by insulated wires delivering current in a way that interferes with muscle control when a human target is successfully fired upon. A variety of such devices is sold by Axon Enterprise, Inc., a Delaware corporation at 17800 N. 85th Street Scottsdale ARIZONA 85255. Such devices may be characterized by one or more of the features: launchers for wire-tethered darts, cartridges containing wire-tethered darts, and launch incident data recorders as a component part of the launcher.

Because the safety net device is designed to rotate, the wiring between the power unit and the external power source may be designed to sever when the unit is rotating. The battery or batteries of the safety net device may be designed to sustain operation of the safety net device for multiple hours of operation after a disconnect from an external power source.

Safety devices described herein may, for example, comprise a microphone array; a net launcher; a rotation control device; a fireable electroshock weapon; and a camera such that the fireable electroshock weapon is arranged and configured to fire into a field of view of the camera; such that the rotation control device is arranged and configured to automatically reorient the net launcher in response to a high decibel event; and such that the net launcher is configured to fire automatically after the high decibel event. In a related example, the rotation control device comprises a servo motor. In a related example, the camera and the fireable electroshock weapon are rotatable together along multiple axes. In a related example, the safety device also includes a transceiver. In a related example, the camera and the fireable electroshock weapon are configured for remote control by an operator. In a related example, the net launcher includes a net having an effective net diameter of 4 feet or greater. In a related example, the net launcher includes a net having an effective net diameter of 6 feet or greater. In a related example, the microphone array, the rotation control device, and the net launcher are arranged and configured to fire the net launcher within one second of the high decibel event. In a related example, the microphone array, the rotation control device, and the net launcher are arranged and configured to fire the net launcher within two seconds of the high decibel event. In a related example, the net launcher has a net launcher firing range of at least 6 feet. In a related example, the fireable electroshock weapon has a fireable electroshock weapon range of at least 6 feet.

Methods of threat mitigation described herein may, for example, comprise identifying a high decibel event over two or more microphones; identifying an originating direction associated with the high decibel event through stereo location; pivoting a net launcher such that the net launcher faces the originating direction; firing a net from the net launcher such that the net travels in the originating direction; pivoting a fireable electroshock weapon in response to the high decibel event; capturing an image on a camera that includes the originating direction in a field of view of the image; and sending the image over a network such that the image is viewable by a first responder. In a related example, the method also includes remotely controlling an orientation of the fireable electroshock weapon. In a related example, the method also includes sending a text message based on the identifying of the high decibel event. In a related example, a servo motor causes the pivoting of the net launcher. In a related example, the firing of the net happens within one second of the high decibel event. In a related example, the firing of the net happens within two seconds of the high decibel event. In a related example, the method also includes distributing a video feed from the camera to a remote operator. In a related example, the net has an effective net diameter of 4 feet or greater. In a related example, the net has an effective net diameter of 6 feet or greater.

The above-described embodiments have a number of independently useful individual features that have particular utility when used in combination with one another including combinations of features from embodiments described separately. There are, of course, other alternate embodiments which are obvious from the foregoing descriptions, which are intended to be included within the scope of the present application.

The invention claimed is:

1. A safety device comprising:

a. a microphone array;

b. a net launcher;

c. a rotation control device;

d. a fireable electroshock weapon; and e. a camera;

f. wherein the fireable electroshock weapon is arranged and configured to fire into a field of view of the camera;

g. wherein the rotation control device is arranged and configured to automatically reorient the net launcher in response to a high decibel event; and h. wherein the net launcher is configured to fire automatically after the high decibel event.

2. The safety device of claim 1 wherein the rotation control device comprises a servo motor.

3. The safety device of claim 1 wherein the camera and the fireable electroshock weapon are rotatable together along multiple axes.

4. The safety device of claim 1 further comprising a transceiver.

5. The safety device of claim 1 wherein the camera and the fireable electroshock weapon are configured for remote control by an operator.

6. The safety device of claim 1 wherein the net launcher comprises a net having an effective net diameter of 4 feet or greater.

7. The safety device of claim 1 wherein the net launcher comprises a net having an effective net diameter of 6 feet or greater.

8. The safety device of claim 1 wherein the microphone array, the rotation control device, and the net launcher are arranged and configured to fire the net launcher within one second of the high decibel event.

9. The safety device of claim 1 wherein the microphone array, the rotation control device, and the net launcher are arranged and configured to fire the net launcher within two seconds of the high decibel event.

10. The safety device of claim 1 wherein the net launcher has a net launcher firing range of at least 6 feet.

11. The safety device of claim 1 wherein the fireable electroshock weapon has a fireable electroshock weapon range of at least 6 feet.

12. A threat mitigation method comprising:

a. identifying a high decibel event over two or more microphones;

b. identifying an originating direction associated with the high decibel event through stereo location;

c. pivoting a net launcher such that the net launcher faces the originating direction;

d. firing a net from the net launcher such that the net travels in the originating direction;

e. pivoting a fireable electroshock weapon in response to the high decibel event;

f. capturing an image on a camera that includes the originating direction in a field of view of the image; and g. sending the image over a network such that the image is viewable by a first responder.

13. The threat mitigation method of claim 12 further comprising remotely controlling an orientation of the fireable electroshock weapon.

14. The threat mitigation method of claim 12 further comprising sending a text message based on the identifying of the high decibel event.

15. The threat mitigation method of claim 12 wherein a servo motor causes the pivoting of the net launcher.

16. The threat mitigation method of claim 12 wherein the firing of the net happens within one second of the high decibel event.

17. The threat mitigation method of claim 12 wherein the firing of the net happens within two seconds of the high decibel event.

18. The threat mitigation method of claim 12 further comprising distributing a video feed from the camera to a remote operator.

19. The threat mitigation method of claim 12 wherein the net has an effective net diameter of 4 feet or greater.

20. The threat mitigation method of claim 12 wherein the net has an effective net diameter of 6 feet or greater.

* * * * *